US005316383A

United States Patent [19]

Begemann et al.

[11] Patent Number: 5,316,383

[45] Date of Patent: May 31, 1994

[54] MIXING SYSTEM FOR MIXING TWO LIQUIDS AT CONSTANT MIXTURE VOLUME FLOW FOR SUPPLYING THE HEADBOX OF A PAPER MACHINE

[75] Inventors: Ulrich Begemann, Leonberg, Fed. Rep. of Germany; Thoroe Scherb, Sao Paulo, Brazil

[73] Assignee: J. M. Voith GmbH, Heidenheim, Fed. Rep. of Germany

[21] Appl. No.: 42,158

[22] Filed: Apr. 2, 1993

[30] Foreign Application Priority Data

Apr. 3, 1992 [DE] Fed. Rep. of Germany ..... 4211291

[51] Int. Cl.[5] ..... B01F 15/04

[52] U.S. Cl. ..... 366/160; 366/336

[58] Field of Search ..... 366/336-340, 366/341, 150, 160

[56] References Cited

U.S. PATENT DOCUMENTS

| | | | |
|---|---|---|---|
| 1,947,329 | 2/1934 | Buttner | 366/336 |
| 2,802,648 | 8/1957 | Christensen | 366/340 |
| 2,894,732 | 7/1959 | Taber | 366/336 |
| 4,018,426 | 4/1977 | Mertz | 366/340 |
| 4,074,363 | 2/1978 | Croft | 366/339 |
| 4,302,113 | 11/1981 | Rumfola | 366/336 |

FOREIGN PATENT DOCUMENTS 4005281 8/1991 Fed. Rep. of Germany .

*Primary Examiner*—Robert W. Jenkins
*Attorney, Agent, or Firm*—Baker & Daniels

[57] ABSTRACT

The invention concerns a mixing system for mixing two liquids at the inlet to the headbox of a paper machine with: an inlet line (A) for the first partial volume flow (a); an inlet line (B) for the second partial volume flow (b); an outlet line (C) for the mixture volume flow (c) with the flow resistance (W); a mixing angle ($\alpha$) with the inlet line (A) and the inlet line (B); a main flow angle ($\beta$) between the inlet line (A) and outlet line (C); a valve (S) installed in the inlet line (B) for control of the partial volume flow (b). The mixing angle ($\alpha$) is selected so that the mixture volume flow (c) remains constant, independent of the partial volume flow (b).

10 Claims, 3 Drawing Sheets

MIXING SYSTEM FOR MIXING TWO LIQUIDS AT CONSTANT MIXTURE VOLUME FLOW FOR SUPPLYING THE HEADBOX OF A PAPER MACHINE

BACKGROUND OF THE INVENTION

The present invention concerns a mixing system for mixing two liquids at a constant mixture volume flow rate for supplying the headbox of a paper machine.

It is known that when mixing two volume flows A and B, with A being uncontrolled and B controlled, a mixture having a volume flow rate with a magnitude normally dependent on the mixing ratio of A to B is produced thereby. In some technical processes, for instance in the production of paper, however, it is desirable or necessary to obtain a constant mixture volume flow which is independent of the mixing ratio of the partial volume flows A and B. This can be accomplished with expensive and elaborate control technology.

A mixing system is known from the German patent document DE-PS 40 05 281 (FIG. 3). Proposed there is introducing diluting water axially in the expanded pressure socket of a connecting line to the headbox. In the specification, it is described that the diluting water should be introduced in the expanded pressure socket of a connecting line contained on the manifold The main claim of the patent even speaks of feeding diluting water into the separate, central manifold, in addition to the fiber suspension. Both proposals presuppose that the flow direction of the dilution component is axial to the connecting line, since the dilution component would otherwise not, or only with a slight part of it, proceed into the connecting line. Input pressure and output pressure of the lines are constant. The sole actuator for modifying the partial volume flow ratio is installed on the dilution water line.

Ensuing problems are these: Since the velocities of both partial volume flows have at the mixing point the same direction but normally differ by amount, energy is transmitted from one to the other partial volume flow. With the momentum theorem, it can be proved that this results in a mutual acceleration and retardation of the respective partial volume flows. Jet pumps utilize this effect for pumping liquids or gases. If a flow resistance, for instance a choke, is located in the line following the mixing point, the effect of the mutual acceleration or retardation diminishes because the partial volume flows displace one another before the flow resistance.

Experiments have shown that with a pressure loss at the flow resistance that is still acceptable for practical use, the acceleration of the main flow through the dilution component is at a 20% share of the dilution component already so high that the volume flow of the mixture, i.e., the sum of main flow and dilution component, increases by about 1% as compared to a dilution component share of 0%. When boosting the share of the dilution component to values of 50% and more, which may be necessary specifically in the marginal area of the headbox, the mixture volume flow change is greater than 8%. That is, a fundamental problem of such a mixing system is constituted in that the mixture volume flow changes heavily in relation to the amount dosed in.

It is also known to provide a mixing system which serves to mix several partial volume flows in such a way that a constant mixture volume flow will be created. To that end, all partial volume flows are controlled dependent on one another by application of an elaborate valve control. The resulting disadvantages are that, for one, such a valve is very expensive in design and manufacture, and of another, in that all volume flows must be controlled. That is, a valve is installed also in the partial volume flow carrying a high fiber concentration, with all negative effects occurring thereby, such as fiber wad formation and clogging tendency.

Additionally, the parallel arrangement requires actuator valves with an extraordinarily linear performance, in order to allow keeping the mixture volume flow constant, independently of the partial volume flow ratio. This good linearity requirement mandates either valves with a steep pressure drop or cost-intensive control measures.

A concept corresponding to the prior art consists in sectioning the headbox across the working width and supplying the individual sections with suspension of different stuff consistency. With increasing stuff consistency of a section, the basis weight of the paper web increases at this point and vice versa.

The fiber orientation of the paper web being a function of the angle at which the jet issues out of the headbox, the fiber orientation can be specifically influenced by modification of the headbox geometry, for instance in the form of geometry changes on the discharge gap. Geometry changes on the head box, depending on working point, influence the amount of suspension issuing out of the headbox in the pertaining section at different degrees. The result of this is that, with the concept described above, an intervention in the fiber orientation profile unintendedly causes also the basis weight to change at the point of intervention of the paper web.

Practical experience and theoretical thoughts regarding the hydraulic conditions in the headbox as well as regarding the mechanism of sheet formation in the wire section show clearly that interventions in the fiber orientation cross profile need to be carried out by far more seldom than interventions in the basis weight cross profile. The illustrated one-sided linkage between the fiber orientation and basis weight is thus in the practical application of the illustrated concept of subordinate significance.

The variation of the stuff consistencies in the individual sections can be achieved in that with each section there is a mixer coordinated in which two partial volume flows of different stuff consistency are mixed with each other and the mixture volume flow is fed exclusively to the respective section of the headbox. An absolute prerequisite for not changing the fiber orientation of the section with a change of the stuff consistency, is the absolute constancy of the mixture volume flow independently of the partial volume ratio adjusted at the mixer.

If adjacent mixture volume flows are not always equally large at a change of the stuff consistency, such will lead to compensating flows transverse to the main flow direction in the headbox, and thus to variations of the jet discharge angle from the machine direction. Since a direction relationship exists between the jet angle and the orientation of the fiber in the paper web, the amounts of the individual mixture volume flows must be absolutely equal and constant across the entire headbox width, also when changes of the stuff consistency are brought about in the individual sections.

Another concept for influencing the fiber orientation profile and the basis weight cross profile provides for a locally, narrowly limited change of the mixture volume flow and the stuff consistency. The effect of the mixture volume flow change on the fiber orientation is based here on the relations described above. The basis weight is adjusted by changing the stuff consistency, with the demand for absolute constancy of the mixture volume flow at stuff consistency changes remaining unchanged also with this concept, so that stuff consistency changes will not at the same time influence the fiber orientation profile. A valve may be installed in the mixture volume flow for adjustment of the fiber orientation.

The required constancy of the mixture volume flows of the individual sections at a change of the partial volume flow ratios will not allow a satisfactory solution either with considerable control expense, since the run time of the basis weight measuring signals is too long for holding the basis weight constant at the prevailing frequency of the basis weight change.

SUMMARY OF THE INVENTION

The problem underlying the present invention is to fashion a simple-design, cost-effective and operationally reliable mixing system in such a way that the mixture volume flow c, independently of the magnitude of the partial volume flow b, remains constant so as to influence the basis weight profile and the fiber orientation cross profile of a paper web extensively independently of one another and in a locally very limited way, and to avoid the above disadvantages of the prior art.

The present invention provides a first inlet line which is disposed relative to a second inlet line at a mixing angle; and which is further disposed relative to an outlet line at a main flow angle. The mixing angle is selected whereby the mixture volume flow remains constant and is independent of the partial flow volume ratio.

An essential idea of the invention is constituted by combining two opposite fluidic effects with each other in such a way that the sum of two partial volume flows a and b entering a mixer will remain always constant, independently of the ratio of the partial volume flows relative to one another and at slight pressure drop at the mixer.

When merging the partial volume flows a and b at an angle $\alpha=90°$ and an angle $\beta=180°$ in the mixer, kinetic energy is transmitted from one flow to the other in the direction of the mixture volume flow, and the dashed curve I illustrated in FIG. 1 is obtained.

The mixture volume flow c decreases at increasing partial volume flow, which is attributable to the increase in turbulence at the point of mixing. This corresponds to the negatively acting effect.

When merging the partial volume flow a and b at the condition $\alpha=90$ and an angle $\beta=180°$, a venturi effect is created which essentially results in an increased mixture volume flow c at increasing partial volume flow b. This corresponds to the positively acting effect illustrated in FIG. 1, curve II.

The inventors now have recognized that a combination of both effects can be achieved by suitable selection of the angles $\alpha$ and $\beta$, in such a way that the decrease of the mixture volume flow, by turbulence at the mixing point, will be exactly compensated for by the venturi effect. That is, always equal mixture volume flows are obtained independently of the partial volume flow ratio.

The solid curve III in FIG. 1 shows the relations measured on an actual mixer. With the angle suitably selected, turbulence and venturi effect are equal in their effect on the mixture volume flow over a large operating range, as shown in FIG. 1.

Since the flow velocities of the partial volume flows influence the turbulence at the mixing point, the angle of the state of equilibrium is a function of the mixer geometry.

A prerequisite of the constancy of the mixture volume flow is the existence of the flow resistance W in the course of the outlet line c and, moreover, that the input pressure of the partial volume flow a, in which no valve is located, and the output pressure of the mixture will be kept constant.

In summary, the invention thus consists in making the energy exchange between the partial volume flows, which causes the acceleration or retardation, by suitable selection of the angles of the partial volume flows relative to each other, and making the pipe diameters so large at the mixing point that the mixture volume flow will always remain constant, independently of the partial volume flow ratio. The fact that the input pressure of a partial volume flow and the output pressure of the mixture volume flow must be constant represents no limitation to a paper machine for the operation of the mixing system, since constant pressures are always desired in the distribution system before the headbox and within the headbox, in order to guarantee unchanging paper properties.

The advantages achieved with the invention are:

1. The mixing system is by design easy to establish, specifically because no particular linearity demands are imposed on the actuator, for instance a control valve.
2. Due to the simple design and low control expense, a considerable cost saving is obtained in terms of purchase cost and operating cost.
3. With no linearity requirements imposed on the actuator, a noncompromising design toward avoidance of fiber wad formation is allowed, if necessary.
4. Owing to saving an actuator and to the simple design, the susceptibility to malfunction is greatly reduced while operational reliability is boosted.
5. No actuator needs to be installed in the partial volume flow with the higher stuff consistency, since the risk of fiber wad formation, as compared to the partial volume flow with a lower stuff consistency, is distinctly greater here.
6. The pressure drop at the mixing system is distinctly lower as compared to conventional solutions, making it possible to use pumps with a lower pressure output, which, in turn, leads to cost reduction.

Thus, the given problem can be solved by the use of a single valve which is specifically tuned to the properties of the fiber suspension and controls a partial volume of low stuff consistency.

The design of the described inlet and outlet lines may assume any cross sectional shape.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
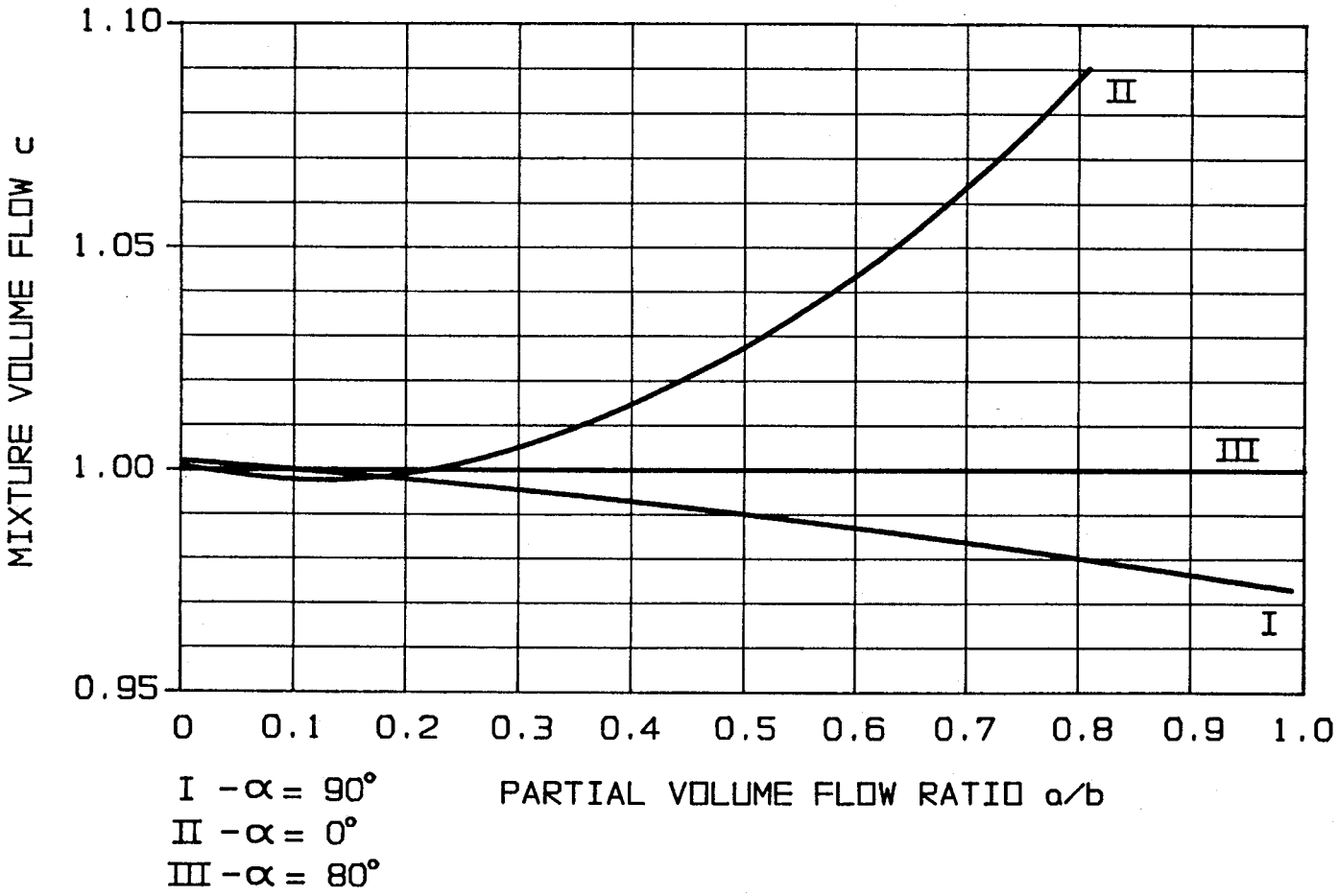
FIG. 1 illustrates test results of one embodiment of the present invention.
Figure 2:
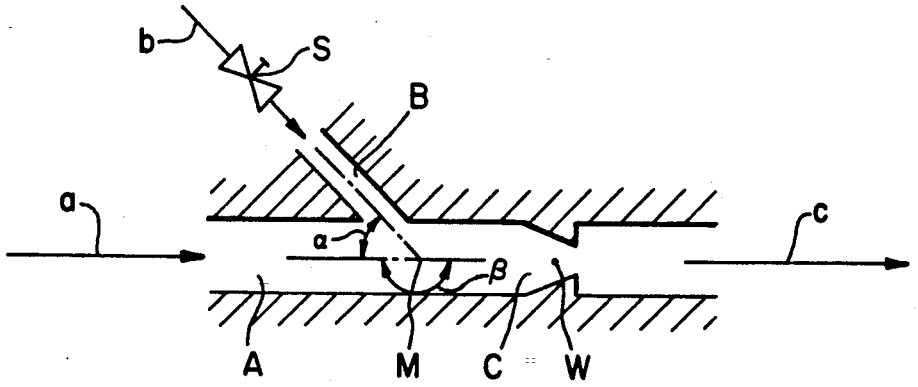
FIG. 2 shows a mixing system connected to a valve and a flow resistance.

FIG. 1 illustrates measuring results obtained with a measuring system according to FIG. 2. Plotted on the abscissa is the partial volume flow ratio a/b, on the ordinate the mixture volume flow c. The curves I, II and III represent test results. Curve I shows the results with a mixing angle of 90°; curve II shows the test results with a mixing angle of $\alpha=0°$ ; and curve III shows the results with an 80° mixing angle, which is a preferred angle for one embodiment of the invention.

FIG. 2 shows a mixing system according to one embodiment of the invention. Illustrated is an inlet line A extending at a straight line and an angle $\beta=180°$ into the outlet line C. At the juncture of inlet line A and outlet line C, the inlet line B, as well as a straight-line inlet line, is introduced at a mixing angle. Installed in the inlet line B is a valve S which controls the magnitude of the partial volume flow b. The partial volume flow b passes through valve S to the mixing space M via the inlet line B, and the partial volume flow a, approaching through the inlet line A, merges with the partial volume flow b and leaves as mixture volume flow c through the outlet line C. Shown stylized in the outlet line C, furthermore, is a flow resistance W, in which resides a necessary prerequisite for the function of the mixing system. Flow resistance W defines a constriction in the region of mixing space M, which may be a variable constriction such as valve S.

Figure 3:
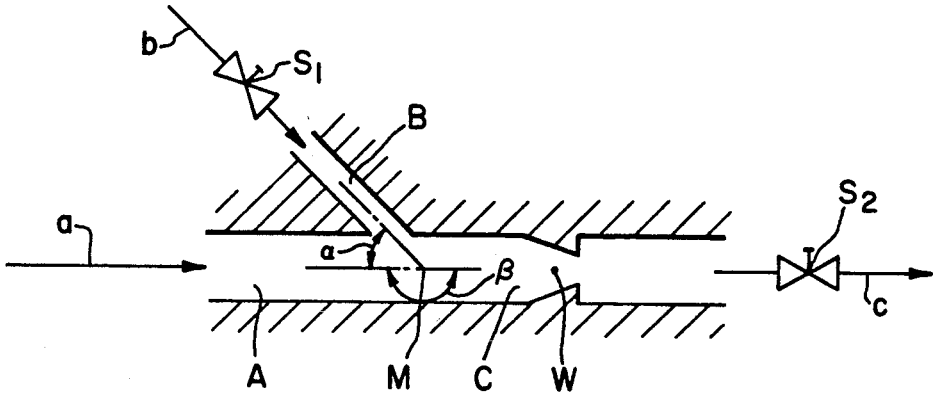
FIG. 3 shows the mixing system of FIG. 2 with an additional a valve disposed in the outlet line.

FIG. 3 shows a mixing system as described in FIG. 1, but in addition to valve $S_1$ installed in the partial, volume flow b there exists a further valve $S_2$, which is installed within outlet line C following the flow resistance W.

Figure 4:
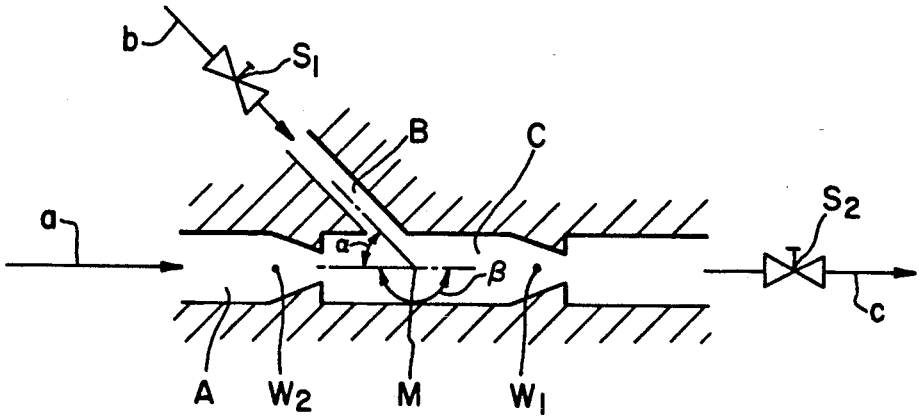
FIG. 4 shows a mixing system with two valves and two flow resistances attached thereto.

FIG. 4 illustrates a mixing system as described in FIG. 3, but in addition to the resistance $W_1$ installed in the outlet line C there exists a second flow resistance $W_2$ within inlet line A.

Figure 5A:
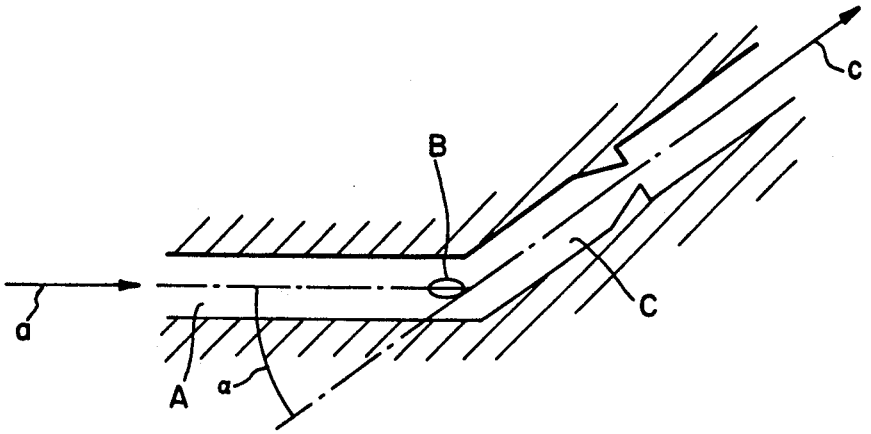
FIG. 5A illustrates a top view of another embodiment of the mixing system of the present invention.
Figure 5B:
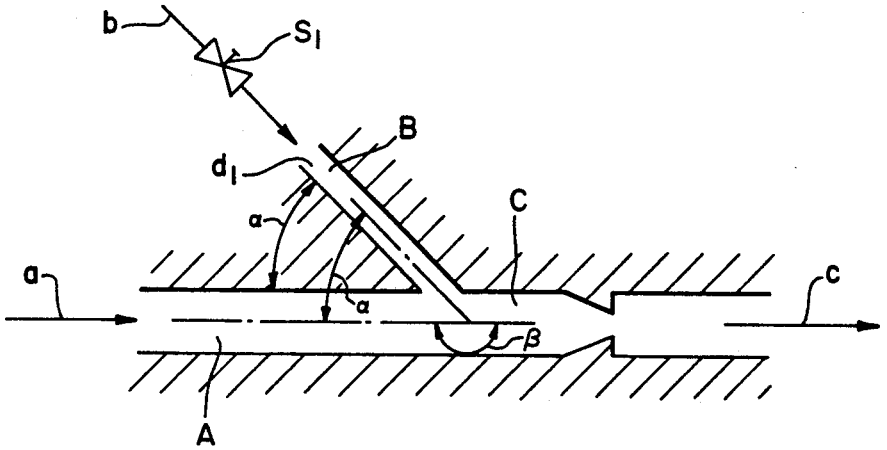
FIG. 5B illustrates a side view taken transverse to the along flow lines a and c shown in FIG. 5A.
Figure 6:
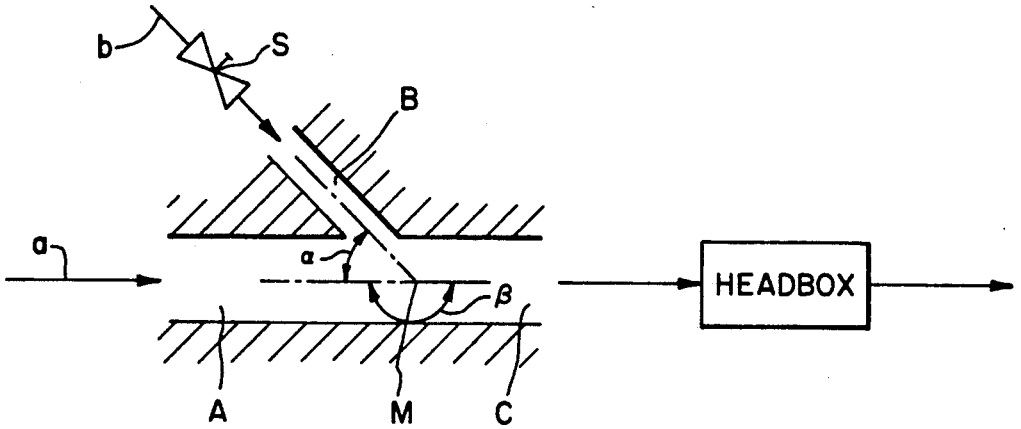
FIG. 6 illustrates another embodiment of a mixing system of the present invention.

FIGS. 5A and 5B show a mixing system similar to that in FIG. 2, but with the inlet lines and outlet line not situated in one plane, but arranged spatially. FIG. 5A shows a plan view illustrating the angle $\gamma$, i.e., the angle between inlet line A and outline line C in a direction generally orthogonal to angle $\beta$ (FIG. 5B); and FIG. 5B shows the mixing system in side elevation.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

WHAT IS CLAIMED IS:

1. A mixing system for mixing two liquids at the inlet to a headbox of a paper machine, said two liquids received by said mixing system at first and second partial volume flow rates respectively and discharged from said mixing system at a mixture volume flow rate, said mixing system comprising:
   - a first inlet line for receiving one of the two liquids at the first partial volume flow rate;
   - a second inlet line for receiving the other of the two liquids at the second partial volume flow rate;
   - an outlet line for transporting said two liquids at the mixture volume flow rate;
   - a first flow resistance disposed in said outlet line; and
   - a valve disposed in said second inlet line for controlling the second partial volume flow rate;
   - said first inlet line disposed relative to said second inlet line at a mixing angle ($\alpha$), said first inlet line disposed relative to said outlet line at a main flow angle ($\beta$), said mixing angle ($\alpha$) selected whereby the mixture volume flow rate remains constant and is independent of said second partial volume flow rate.

2. The mixing system of claim 1, wherein said mixing angle ($\beta$) is in the range of $0° \leqq \alpha \leqq 90°$.

3. The mixing system of claim 1, wherein said first flow resistance comprises a separate flow resistance connected to said outlet line.

4. The mixing system of claim 1, wherein said main flow angle $\beta$ is about 180°.

5. The mixing system of claim 1, wherein said first and second inlet lines and said outlet line are disposed in different planes, whereby an additional spatial angle ($\gamma$) is formed.

6. The mixing system of claim 1, further comprising a valve in the outlet line for control of the mixture volume flow rate.

7. The mixing system of claim 1, wherein said flow resistance comprises a headbox.

8. The mixing system of claim 1, further comprising second flow resistance disposed in said first inlet line.

9. The mixing system of claim 8, wherein said first and second flow resistances are variable.

10. The mixing system of claim 1, wherein at least one of said first and second inlet lines and said outlet line has a variable constriction in the region of a mixing space.

* * * * *